US010180308B2

(12) United States Patent
Lang et al.

(10) Patent No.: US 10,180,308 B2
(45) Date of Patent: Jan. 15, 2019

(54) BALLISTIC SHIELD WITH BOLTLESS VIEWPORT

(71) Applicant: Safariland, LLC, Jacksonville, FL (US)

(72) Inventors: Thomas Patrick Lang, Great Barrington, MA (US); Mark Cardey, Jacksonville, FL (US); Dan McNeil, Fernandina Beach, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 15/801,519

(22) Filed: Nov. 2, 2017

(65) Prior Publication Data

US 2018/0120064 A1 May 3, 2018

Related U.S. Application Data

(60) Provisional application No. 62/416,776, filed on Nov. 3, 2016.

(51) Int. Cl.
*F41H 7/00* (2006.01)
*F41H 5/08* (2006.01)

(52) U.S. Cl.
CPC ..... *F41H 5/08* (2013.01)

(58) Field of Classification Search
CPC ..... F41H 5/06; F41H 5/08; F41H 5/12; F41H 5/14; F41H 5/16; F41H 5/26; F41H 5/263
See application file for complete search history.

(56) References Cited

U.S. PATENT DOCUMENTS 1,279,571 A * 9/1918 Moloney ..... F41H 5/08 109/58.5
2,316,055 A 4/1943 Davey
3,745,938 A 7/1973 Hathaway
4,674,394 A 6/1987 Martino
5,850,052 A * 12/1998 Gabriel ..... F41H 5/08 89/36.05
6,000,347 A 12/1999 Madden, Jr.
6,276,100 B1 8/2001 Woll
(Continued)

FOREIGN PATENT DOCUMENTS

DE 3142365 A1 * 5/1983 ..... A61B 5/15003
WO WO-2007146792 A2 * 12/2007 ..... F41C 33/0209

OTHER PUBLICATIONS

PCT Appln. No. PCT/US17/59677; PCT Search Report and Written Opinion dated Jan. 12, 2018.

*Primary Examiner* — Gabriel J. Klein
(74) *Attorney, Agent, or Firm* — Kane Kessler, P.C.; Paul E. Szabo

(57) ABSTRACT

A ballistic shield has a strike face and a body side and includes a ballistic panel and a viewport. Plies of ballistic material are formed together as the ballistic panel. A pocket in the ballistic panel is recessed into the strike face of the panel, and is at least partially defined by a pocket wall that is offset from a main body portion of the ballistic panel in a direction away from the strike face. The pocket wall has an opening forming a viewing area that is circumscribed by a frame section of the pocket wall. A viewport is secured in the pocket with a first section of the viewport overlying the frame section of the pocket wall and a second section of the viewport overlying the viewing area.

7 Claims, 4 Drawing Sheets

(56) References Cited

U.S. PATENT DOCUMENTS

| | | | | |
|---|---|---|---|---|
| 6,708,595 | B1 | 3/2004 | Chaussade | |
| 6,807,890 | B1 | 10/2004 | Fuqua | |
| 7,716,748 | B2 | 5/2010 | Dovner | |
| 8,176,830 | B1 * | 5/2012 | Tan | F41H 5/0428 89/36.02 |
| 8,276,498 | B1 | 10/2012 | Hannibal et al. | |
| 8,337,970 | B2 | 12/2012 | Pfister | |
| 8,408,114 | B1 | 4/2013 | Tan | |
| 8,418,595 | B1 | 4/2013 | Saucedo et al. | |
| 2004/0144243 | A1 | 7/2004 | Newkirk | |
| 2012/0090452 | A1 | 4/2012 | Sudhakar | |
| 2012/0180631 | A1 * | 7/2012 | Sporn | F41H 5/0485 89/36.02 |
| 2013/0119201 | A1 * | 5/2013 | Villanueva Montero | B64D 45/00 244/129.1 |

* cited by examiner

BALLISTIC SHIELD WITH BOLTLESS VIEWPORT

BACKGROUND OF THE INVENTION

This invention relates to a ballistic shield of the type that is carried by is enforcement or tactical operators in situations involving the threat of handgun and/or rifle assaults.

This type of shield is manufactured from multiple plies of ballistic resistant material that are permanently compressed together in a process employing heat and pressure. Pressing the multiple layers of ballistic resistant material into one panel provides the shield its ballistic resistant capabilities, defeating handgun and/or rifle threats.

Users of these ballistic shields often need to be able to see from behind the protection of the shield during missions. However, the compressed ballistic material that forms the panel is opaque. Therefore, many ballistic shields are designed to include transparent viewports. A viewport, also known as a lens, is a piece of transparent ballistic resistant material (often ballistic resistant glass, polycarbonate, hardcoat or acrylic) that is secured into the ballistic material panel, enabling the operator to see through the shield without being further exposed to the ballistic threat.

There are several known techniques for securing the viewport to the ballistic material panel of the shield. The most common method involves cutting an opening in the desired shape of the viewport, through the material of the panel. The viewport is then placed into the opening and clamped to the panel via a lens cap or bezel extending around the edge of the viewport, the lens cap being bolted through or adhered to the ballistic panel of the shield.

This viewport installation method is effective but results in a shield that is substantially heavier and bulkier than a shield without a viewport. The bolts and the lens cap do not lie flush with the ballistic material panel and exterior skin of the shield, and are individual extra components that must be added to the body of the shield. In addition, the bolts required to secure the viewport to the ballistic material panel are placed through openings that are drilled through the pressed ballistic materials. Making such openings allows for potential points of weakness in overall ballistic integrity because the ballistic panel is not a single, continuous piece.

SUMMARY OF THE INVENTION

This invention provides a new way of securing the viewport in the ballistic panel. In brief, a pocket is pressed into the ballistic material as the panel is being formed, extending toward the body side of the ballistic panel. A portion of the wall of the pocket is cut out to form an opening in which the viewport is secured by adhesive. No bolts or drilled openings are needed, and ballistic characteristics of the shield are continuous across the entire viewport area.

BRIEF DESCRIPTION OF THE DRAWINGS

Further features of the invention will become apparent to one of ordinary skill in the art from a reading of the following description of an embodiment of the invention together with the accompanying drawings, in which.

DETAILED DESCRIPTION

Figure 1:
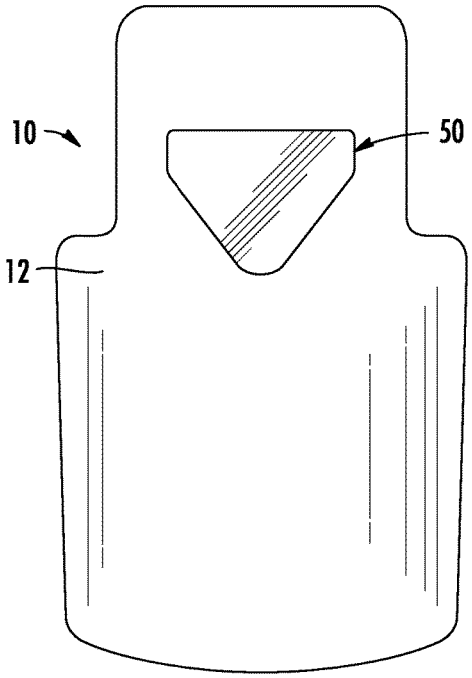
FIG. 1 is a pictorial illustration of a ballistic shield that is a first embodiment of the invention, as viewed from the strike side.

This invention relates to a ballistic shield. The invention is applicable to ballistic shields of different constructions. As representative of the invention, FIG. 1 illustrates a ballistic shield 10 that is a first embodiment of the invention.

Figure 2:
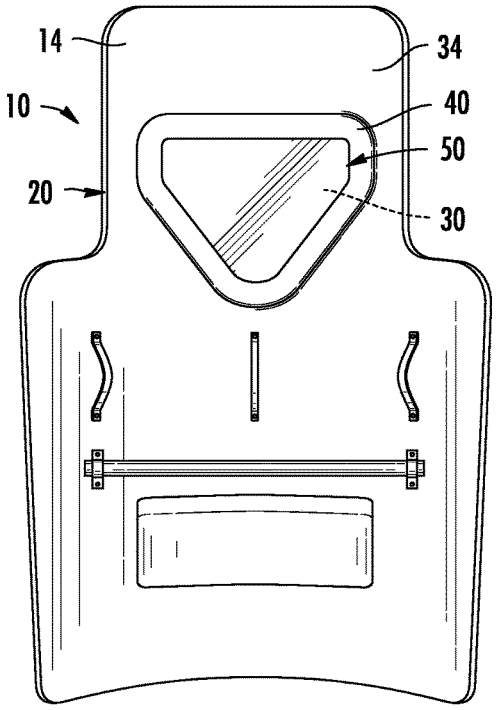
FIG. 2 is a pictorial illustration of the ballistic shield of FIG. 1, as viewed from the body side.
Figure 3:
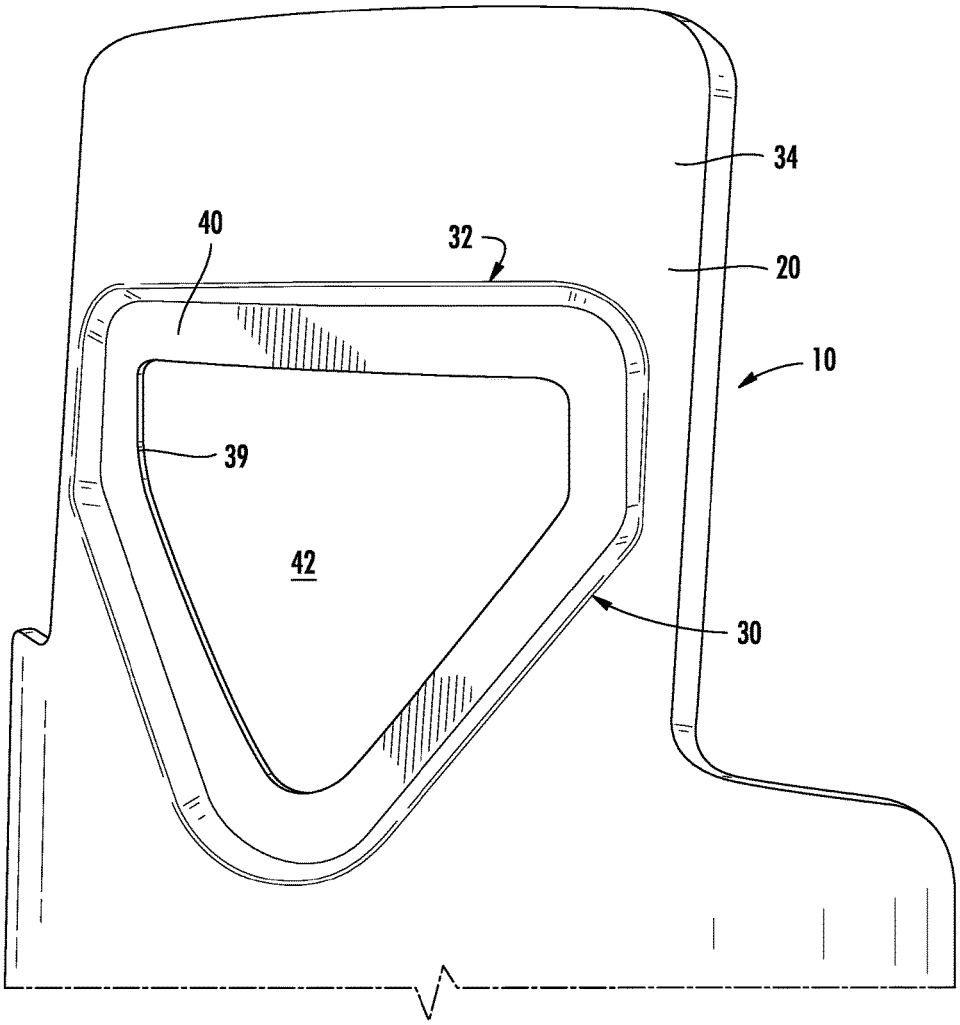
FIG. 3 is an enlarged perspective view of a ballistic panel that forms part of the shield of FIG. 1, shown at a point in the shield manufacturing process before the shield's viewport is added.
Figure 4:
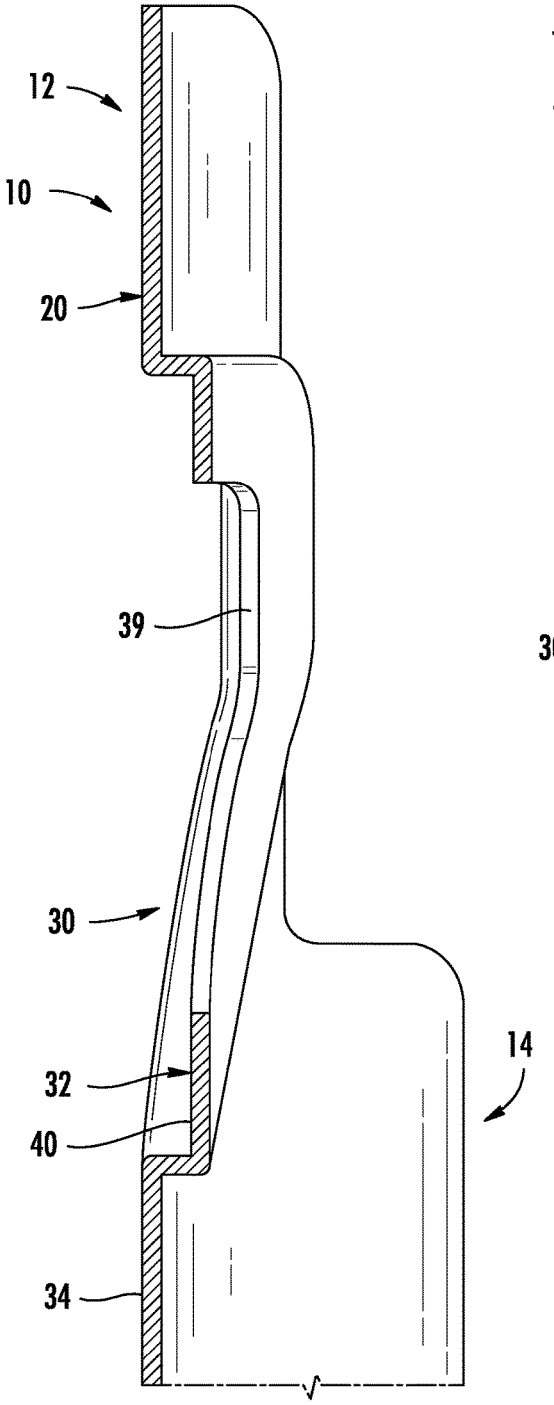
FIG. 4 is a schematic sectional view through a portion of the shield of FIG. 3, before the shield's viewport is added.

The shield 10 has an exterior surface 12, which is presented outward away from the user when the shield is being carried, and which is referred to as the strike face or strike side of the shield. The shield 10 has an interior surface 14, which is adjacent to the user when the shield is being carrier, and which is referred to as the body side of the shield. In the drawings, FIGS. 1 and 3 show generally the strike face 12, while FIG. 2 shows generally the body side 14.

On the body side 14 of the shield 10 there are typically located several conventional features, such as handles, arm comfort padding and quick release straps. There also may be provided structure for holding accessories, such as a flashlight or a baton.

Figure 6:
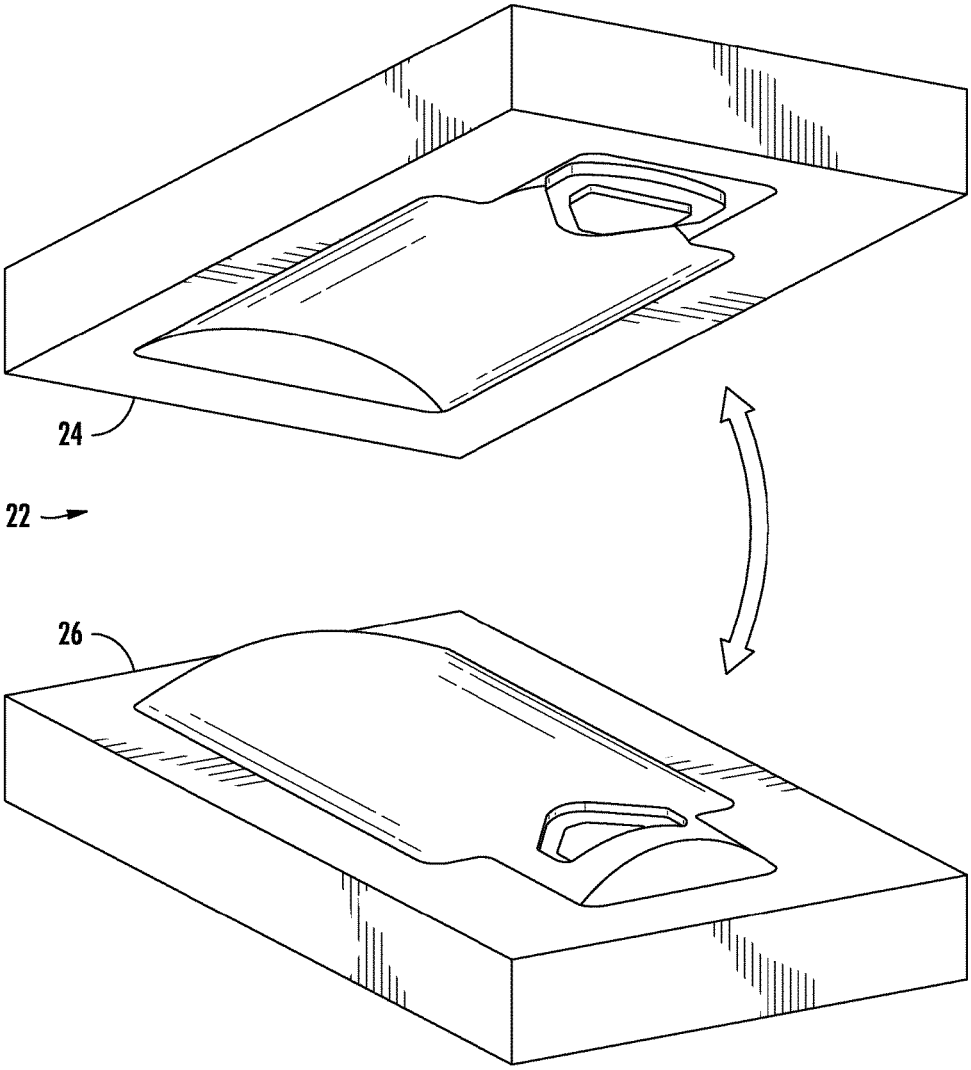
FIG. 6 is a schematic illustration of the molding process of the shield.

The majority of the shield 10 is composed of a ballistic material panel 20 ("ballistic panel"). The panel 20 is formed in a known manner by assembling multiple plies of ballistic resistant material and molding under heat and pressure to form a panel having opposite inner and outer major side surfaces. The mold as shown schematically at 22 (FIG. 6) includes two mold parts 24 and 26 that are configured to provide the molded panel 20 with its final shape.

The mold parts 24 and 26 additionally are configured to provide a pocket 30 (FIG. 3) in the molded panel 20, for receiving a lens or viewport 50. Specifically, when the mold parts 24 and 26 are brought together on the assembled plies of ballistic material, the pocket 30 that is formed extends toward the body side 14 of the panel 20. In the illustrated embodiment, the resulting molded panel 20 itself has a thickness in the range of from about 0.1" to about 0.3", and preferably about 0.2". The pocket 30 has a depth in the range of from about 0.5" to about 1.25", and preferably about 0.875". The pocket 30 terminates in and is bounded by a pocket wall 32 that extends generally parallel to the main body portion 34 of the panel 20, at the offset of about 0.875' from the main body portion of the panel. The pocket wall 34 is substantially the same size and shape as the lens 50 to be added. The pocket 30 has the same depth and shape as the lens 50 to be added, and is formed on and extends inward from the strike side 12 of the panel as molded.

After the panel 20 is cooled, a central part of the pocket wall 32 is cut away at an edge 39, leaving a rim or frame 40 that in the illustrated embodiment is about two inches in width. This removal of material forms the viewing area or opening 42 through which the operator can see via the lens 50.

Figure 5:
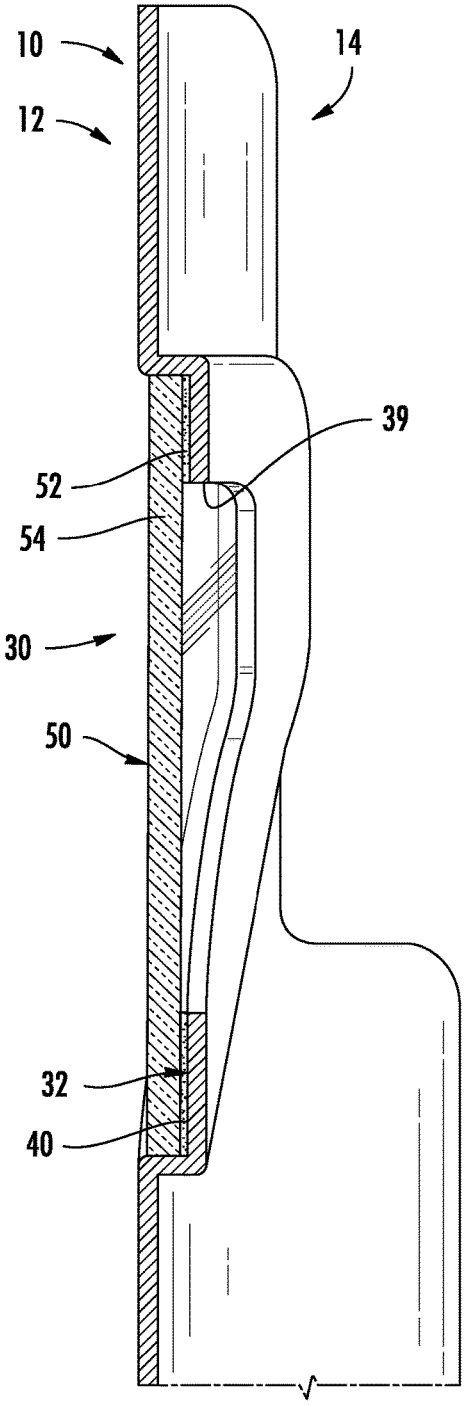
FIG. 5 is a view similar to FIG. 4, showing the same shield portion after the shield's viewport is added.

The lens 50 (FIG. 5) is then mounted on the rim 40, being placed by moving it in a direction from the strike side 12 toward the body side 14. The lens 50 fits into the pocket 30. An adhesive shown schematically at 52 is used between the outer edge portion 54 of the lens 50 and the rim 40, to secure the lens to the panel 20. When the lens 50 is thus secured to the panel 20, the outer surface of the lens is basically flush with the strike face 12 of the panel.

A layer of protective material or skin (not shown) may be placed over the strike side 12 of the shield 10, including a cut-out for the lens 50, and covering the outer peripheral portion 54 of the lens. This protective material can help to maintain the lens 50 in position on the panel 20.

Construction of the shield 10 may be completed in a known manner, for example with edging being placed around the perimeter of the shield, and handles, straps or optional lighting systems installed, preferably also in a boltless configuration.

There are numerous advantages to this new method of ballistic resistant shield 10 manufacturing. First, this boltless design eliminates traditional points of weakness in the ballistic integrity of the shield, that are caused by bolts and drill holes. The single, continuous ballistic resistant component (and proper ballistic overlap between the lens and the panel) ensures overall ballistic integrity. Because both the panel 20 itself and the lens 50 are made of ballistic material, and because they overlap at the area of the rim 40, the ballistic resistant characteristics of the shield 10 are continuous across the area of the view port. There are no bolt holes or such that would be absent of ballistic material. As a result, the ballistic resistant characteristics of the panel are not compromised by the inclusion of the viewport 40.

Second, for a shield with viewport that is otherwise the same, the overall weight of the ballistic shield is reduced by elimination of the additional tool and hardware components utilized in the traditional method of shield production. This weight reduction is an important quality for shield functionality and maneuverability. The reduction in components and pieces also results in a smooth, low-profile configuration, as is preferable for covert operations.

Third, this new process eliminates the need for certain tooling and hardware. Other methods of shield manufacturing require a separate lens cap to secure the viewport into place, as well as bolts, washers and drill tools necessary for proper installation. The process of the present invention only requires the basic components of the ballistic shield—i.e. ballistic panel, viewport 40, skin.

The invention is not limited to the illustrated embodiment and dimensions. As but one non-limiting example, the main body portion of the panel could be anywhere up to about one inch or more thick. A thicker or thinner lens could be provided, thus requiring an appropriate offset for the pocket wall. The offset could be in the direction of the strike face not the body side. All such variations are included and are intended to be covered by the appended claims.

The invention claimed is:

1. A method of manufacturing a ballistic shield that includes a ballistic panel and a viewport, comprising the steps of:

assembling plies of ballistic material that are to be formed together as the ballistic panel into an assembly having first and second opposite major side surfaces;

forming the ballistic panel with a strike face and a body side by bringing first and second mold parts together under heat and pressure on the assembled plies of ballistic material, the ballistic panel as formed having a main body portion;

said step of forming the ballistic panel including the step of forming a pocket in the ballistic panel, the pocket being recessed into the strike face of the panel, the pocket being at least partially defined by a pocket wall that is offset from a main body portion of the ballistic panel;

removing a section of the pocket wall to form a viewing area in the panel, while leaving an outer peripheral edge portion of the pocket wall in place with the main body portion of the ballistic panel to form a frame for the viewing area; and securing a viewport in the pocket with a first section of the viewport overlying the frame and a second section of the viewport overlying the viewing area.

2. A method as set forth in claim 1 wherein the step of securing a viewport consists of securing a viewport to the frame only with adhesive.

3. A method as set forth in claim 1 wherein the step of forming a pocket includes forming a pocket that is the size and shape of the viewport that is to be provided.

4. A method as set forth in claim 1 wherein the step of forming the main body portion of the panel includes forming a main body portion in the range of about 0.2" thickness, and the step of forming a pocket includes forming pocket wall that is offset by about 0.875" from the main body portion of the panel.

5. A method as set forth in claim 1 wherein the step of securing a viewport includes securing a viewport flush with the strike face of the shield.

6. A method as set forth in claim 1 wherein the step of securing the viewport to the panel is performed without bolts and without cutting any holes in the panel.

7. A method as set forth in claim 1 wherein:

the step of securing a viewport consists of securing a viewport to the frame only with adhesive;

the step of forming a pocket includes forming a pocket that is the size and shape of the viewport that is to be provided; and the step of securing the viewport to the panel is performed without bolts and without cutting any holes in the panel.

* * * * *